US005907963A

United States Patent [19]

Myers et al.

[11] Patent Number: 5,907,963

[45] Date of Patent: Jun. 1, 1999

[54] LOCK ASSEMBLY WITH A KEY-ACTIVATED REMOVABLE CORE STRUCTURE

[75] Inventors: Gary L. Myers, Monee; Aurelia Constanta Haiduc, Chicago, both of Ill.

[73] Assignee: Fort Lock Corporation, River Grove, Ill.

[21] Appl. No.: 08/918,753

[22] Filed: Aug. 25, 1997

[51] Int. Cl.[6] ..... E05B 9/04

[52] U.S. Cl. ..... 70/371; 70/379 R; 70/452

[58] Field of Search ..... 70/367–371, 379 R–381, 70/417, 452, 492, 208

[56] References Cited

U.S. PATENT DOCUMENTS

| | | | |
|---|---|---|---|
| 1,304,105 | 5/1919 | Segal | 70/381 |
| 1,948,765 | 2/1934 | Kulicke | 70/369 |
| 2,049,742 | 8/1936 | Lowe | 70/369 X |
| 2,065,683 | 12/1936 | Gahagan | 70/369 |
| 3,630,054 | 12/1971 | Malminen | 70/452 |
| 3,690,132 | 9/1972 | Engstrom | 70/373 |
| 3,699,790 | 10/1972 | Ansala | 70/364 |
| 4,051,703 | 10/1977 | Plaiss | 70/371 |
| 4,099,397 | 7/1978 | Dauenbaugh | 70/371 |
| 4,644,768 | 2/1987 | Nowak et al. | 70/364 |
| 4,759,204 | 7/1988 | Neyret | 70/369 X |
| 4,899,561 | 2/1990 | Myers | 70/208 |
| 4,903,512 | 2/1990 | Leroy et al. | 70/379 R |
| 4,947,664 | 8/1990 | Lindmayer et al. | 70/379 R X |
| 5,119,654 | 6/1992 | Ceron et al. | 70/369 |
| 5,121,618 | 6/1992 | Scott | 70/371 X |
| 5,216,910 | 6/1993 | Lin | 70/452 X |
| 5,263,348 | 11/1993 | Wittwer | 70/379 R |
| 5,265,453 | 11/1993 | Konii et al. | 70/379 R |
| 5,265,455 | 11/1993 | Grimmer | 70/492 |
| 5,295,377 | 3/1994 | Moricz et al. | 70/370 X |
| 5,351,513 | 10/1994 | Ellis | 70/452 X |
| 5,442,943 | 8/1995 | Schremmer et al. | 70/371 X |
| 5,563,387 | 10/1996 | Myers et al. | 200/43.03 |
| 5,595,079 | 1/1997 | Myers | 70/233 |
| 5,606,882 | 3/1997 | Larsen et al. | 70/371 X |
| 5,634,358 | 6/1997 | Myers | 70/233 |
| 5,634,359 | 6/1997 | Huebschen | 70/370 X |
| 5,732,580 | 3/1998 | Garnault et al. | 70/379 R X |

*Primary Examiner*—Suzanne Dino Barrett
*Attorney, Agent, or Firm*—Banner & Witcoff, Ltd.

[57] ABSTRACT

A lock assembly is provided with a key-activated removable core structure. The lock assembly includes a housing having a first internal compartment disposed at a front end thereof, a second internal compartment disposed at a rear end thereof, and a partition with an aperture and a radial slot therethrough for segregating the first and second internal compartments. The removable core structure is selectively removably disposed within the first internal compartment of the housing and a cam actuation assembly is captively rotatably disposed within the second internal compartment of the housing. The removable core structure includes an exterior shell portion and a key-activated lock plug assembly with a distal driver portion rotatably disposed within the shell portion for rotation between distinct operating positions. The cam actuation assembly selectively removably receives the driver portion of the lock plug assembly and is provided with a biasing element which urges the core structure into a first axial position with respect to the front end of the housing. In use, the cam actuation assembly interacts with the driver portion of the lock plug assembly to permit selective removal of the core structure from the first internal compartment of the housing depending upon the axial position of the core structure and the operating position of the lock plug assembly.

18 Claims, 5 Drawing Sheets

FIG. 4
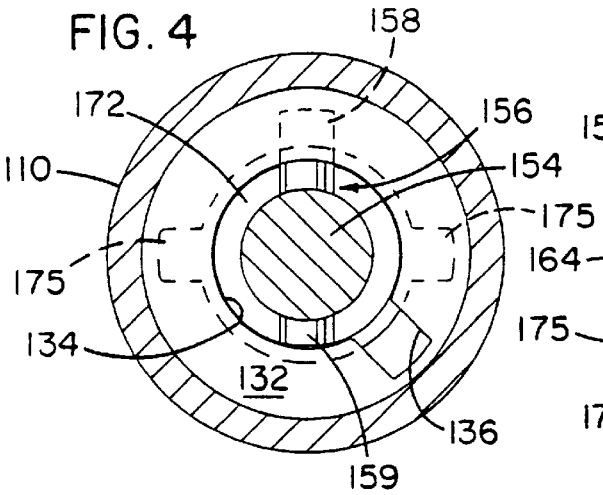
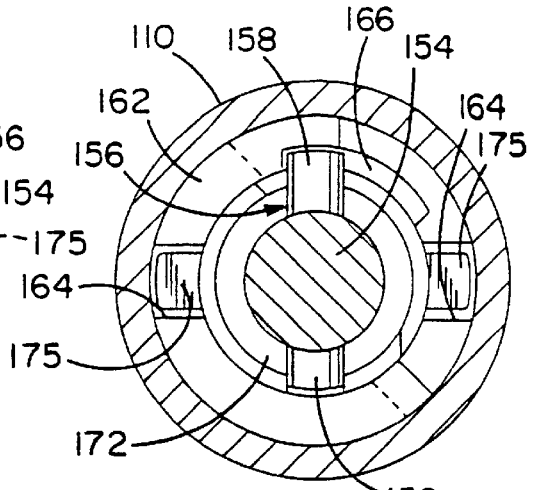
FIG. 4A
FIG. 5
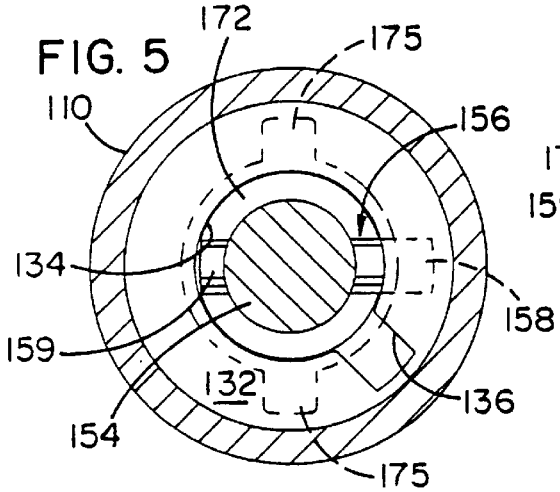
FIG. 5A
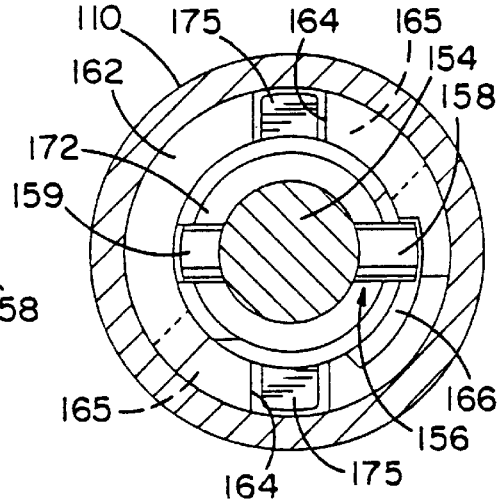
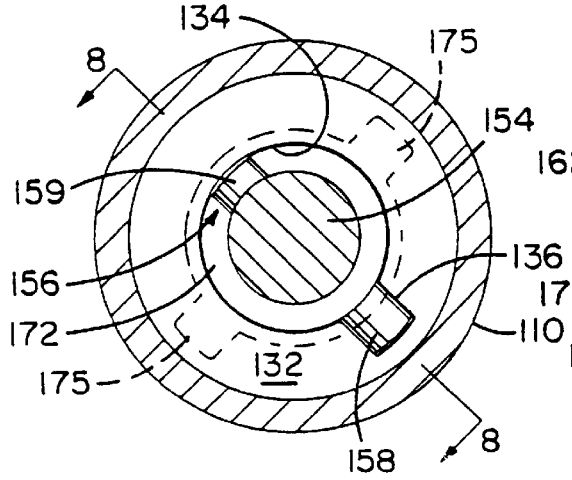
FIG. 6
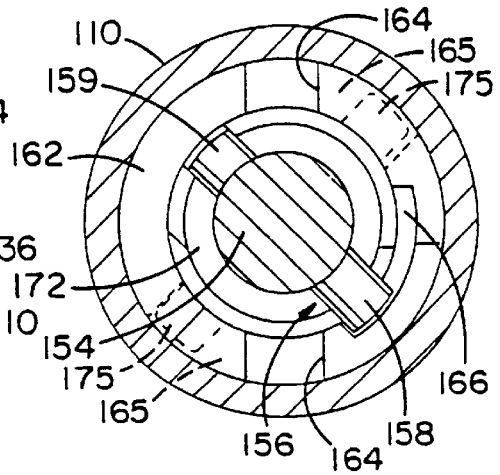
FIG. 6A

LOCK ASSEMBLY WITH A KEY-ACTIVATED REMOVABLE CORE STRUCTURE

FIELD OF THE INVENTION

The present invention relates generally to locking devices and, more particularly, to a lock assembly with a key-activated removable core structure.

BACKGROUND OF THE INVENTION

Conventional prior art lock assemblies typically include a lock plug selectively rotatably disposed within a housing structure and a specially-encoded key for turning the lock plug with respect thereto. In use, such lock assemblies may be "changed" to accept a different key by removing, reconfiguring, and reinstalling the existing lock plug or by removing the existing lock plug and replacing it with a different lock plug. Either procedure, however, typically requires ample time, specialized equipment, and/or a skilled locksmith.

OBJECTS OF THE INVENTION

Accordingly, a general object of the present invention is to provide a lock assembly which may be quickly and easily "changed" to accept a different key.

A related object of the present invention is to provide a lock assembly which may be conveniently "changed" without the use of a locksmith or specialized equipment.

A further object of the present invention is to provide a lock assembly with a key-activated removable core structure.

A related object of the present invention is to provide a core structure with an affiliated lock plug assembly which may be collectively removed from a housing with a key.

A more specific object of the present invention is to provide a core structure with an affiliated lock plug assembly which may be collectively removed from a housing by inserting a key into the lock plug assembly, by turning the lock plug assembly to an appropriate position, and by withdrawing the key, the core structure, and the affiliated lock plug assembly from the housing as a unit.

Another object of the present invention is to provide a core structure with an affiliated lock plug assembly which may be collectively removed from a housing and replaced with a different core structure.

An additional object of the present invention is to provide a core structure with an affiliated lock plug assembly wherein the lock plug assembly may be turned with respect to a housing with a key and wherein the core structure and the lock plug assembly may be collectively removed from the housing with the same key.

Still another object of the present invention is to provide a lock assembly having the foregoing features which is reliable, durable, and convenient to use.

SUMMARY OF THE INVENTION

Accordingly, a lock assembly is provided which accomplishes these and other objects and overcomes the above-identified deficiencies of the prior art. The inventive lock assembly includes a housing having a first internal compartment disposed at a front end thereof, a second internal compartment disposed at a rear end thereof, and a partition with an aperture and a generally radial slot therethrough for segregating the first and second internal compartments. The inventive lock assembly is also provided with a core structure which is selectively removably disposed within the first internal compartment of the housing and a cam actuation assembly which is captively rotatably disposed within the second internal compartment.

The removable core structure includes an exterior shell portion and an interior lock plug assembly which is rotatably disposed within the shell portion for movement between first, second, and third operating positions when turned by a properly-fitting key. The lock plug assembly includes a distal driver portion with a generally transverse member such as a pin. In use, the pin interacts with the partition of the housing and the radial slot of the partition to permit selective removal of the core structure from the first internal compartment of the housing.

The cam actuation assembly is adapted to selectively retain the core structure within the first internal compartment of the housing and is provided with an exterior drum portion, an interior insert portion disposed within the drum portion, and a biasing element for urging the core structure into a first axial position with respect to the front end of the housing. The insert portion has a bore therein which removably receives the driver portion of the lock plug assembly and at least one longitudinal slot which removably receives the transverse pin of the driver portion. In addition, the drum portion also includes a pair of opposed channels with generally longitudinal and transverse segments which receive opposed protrusions formed on the insert portion, and an arcuate interior notch which removably receives the pin of the driver portion. On account of this construction, the insert portion rotates in conjunction with the pin of the driver portion, and the drum portion selectively rotates with respect to the insert portion.

In operation, the cam actuation assembly interacts with the driver portion of the lock plug assembly to permit selective removal of the core structure from the first internal compartment of the housing depending upon the axial position of the core structure and the operating position of the lock plug assembly. For example, when the core structure is in the first axial position and the lock plug assembly is in either the first or second operating positions, the core structure may not be removed from the housing due to obstructive engagement between the pin of the driver portion and the partition of the housing. When the core structure is moved inwardly into a second axial position with respect to the front end of the housing and the lock plug assembly is moved into the third operating position, however, interplay between the driver portion of the lock plug assembly and the drum and insert portions of the cam actuation assembly causes the pin of the driver portion to be aligned with the radial slot of the partition which permits the core structure to be conveniently removed from the first internal compartment of the housing.

These and other objects, features, and advantages of the present invention will become more apparent upon reading the following detailed description of a preferred exemplified embodiment and upon reference to the following drawings wherein:

BRIEF DESCRIPTION OF THE DRAWINGS

FIG. 4 is an enlarged cross-sectional view of the lock assembly taken along line 4—4 of FIG. 3;

FIG. 4A is an enlarged cross-sectional view of the lock assembly taken along line 4A—4A of FIG. 3;

FIG. 5 is an enlarged cross-sectional view of the lock assembly taken along line 4—4 of FIG. 3, but showing the lock plug assembly of the removable core structure in a second operating position;

FIG. 5A is an enlarged cross-sectional view of the lock assembly taken along line 4A—4A of FIG. 3, but showing the lock plug assembly of the removable core structure in the second operating position;

FIG. 6 is an enlarged cross-sectional view of the lock assembly taken along line 4—4 of FIG. 3, but showing the lock plug assembly of the removable core structure in a third operating position;

FIG. 6A is an enlarged cross-sectional view of the lock assembly taken along line 4A—4A of FIG. 3, but showing the lock plug assembly of the removable core structure in the third operating position;

While the present invention will be described and disclosed in connection with a preferred exemplified embodiment, the intent is not to limit the present invention to this specific embodiment. On the contrary, the intent is to cover all such alternatives, modifications, and equivalents that fall within the spirit and scope of the present invention as defined by the appended claims.

DETAILED DESCRIPTION OF THE PREFERRED EMBODIMENT

Figure 8:
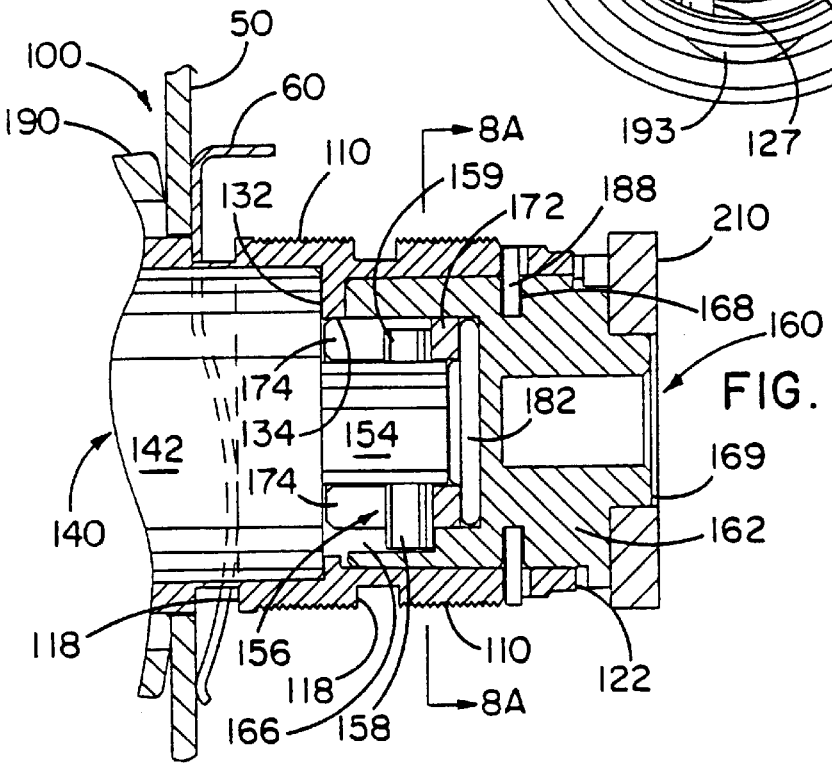
FIG. 8 is a cross-sectional view of the lock assembly taken along line 8—8 of FIG. 6.
Figure 8A:
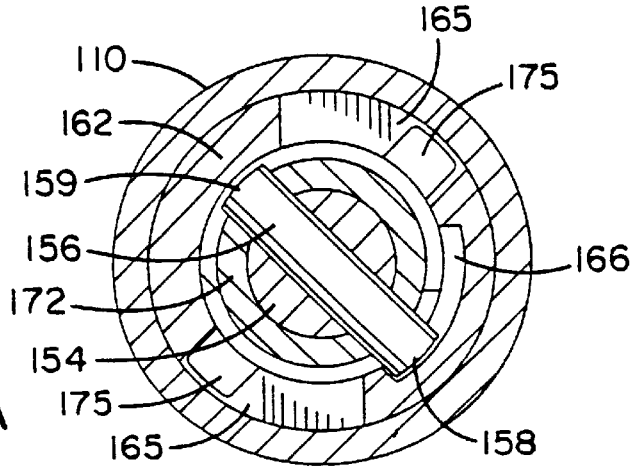
FIG. 8A is an enlarged cross-sectional view of the lock assembly taken along line 8A—8A of FIG. 8.

Turning now to the drawings, a lock assembly having a key-activated removable core structure constructed in accordance with the present invention is generally designated by reference numeral 100. As shown, for example, in FIGS. 3, 8, and 8B, the inventive lock assembly 100 is adapted to be received by a hole in an external mounting structure, such as a panel 50 or the like, and then mounted to the external mounting structure 50 with a lock clip 60, as disclosed, for example, in U.S. Pat. No. 5,636,540. More specifically, the inventive lock assembly 100 is secured to the panel 50 by sandwiching the panel 50 between the lock clip 60 and a security collar 190. Although the inventive lock assembly 100 is shown mounted to panel 50 with lock clip 60 and security collar 190, it will be readily appreciated by those skilled in the art that the lock assembly 100 may alternatively be mounted to other structures and in other manners without departing from the scope or spirit of the present invention.

As best shown in FIGS. 3, 8, 8B, and 12, the inventive lock assembly 100 includes a housing 110 having a first internal compartment 114 disposed at a front end 112 thereof, a second internal compartment 124 disposed at a rear end 122 thereof, and a partition 132 which segregates the first and second internal compartments 114 and 124. As shown in FIGS. 4, 5, and 6, the partition 132 has a generally circular aperture 134 therethrough with a generally radial slot 136. In addition, the front end 112 of the housing 110 includes an annular flange 116 with opposed notches 117, while the rear end 122 includes a set of first and second stop surfaces 126 and 127. A plurality of spaced apart recesses or channels 118 are also provided along the exterior of the housing 110 to provide convenient engagement surfaces for the lock clip 60 when the lock assembly 100 is mounted to panel 50 or to another external mounting structure.

Figure 3:
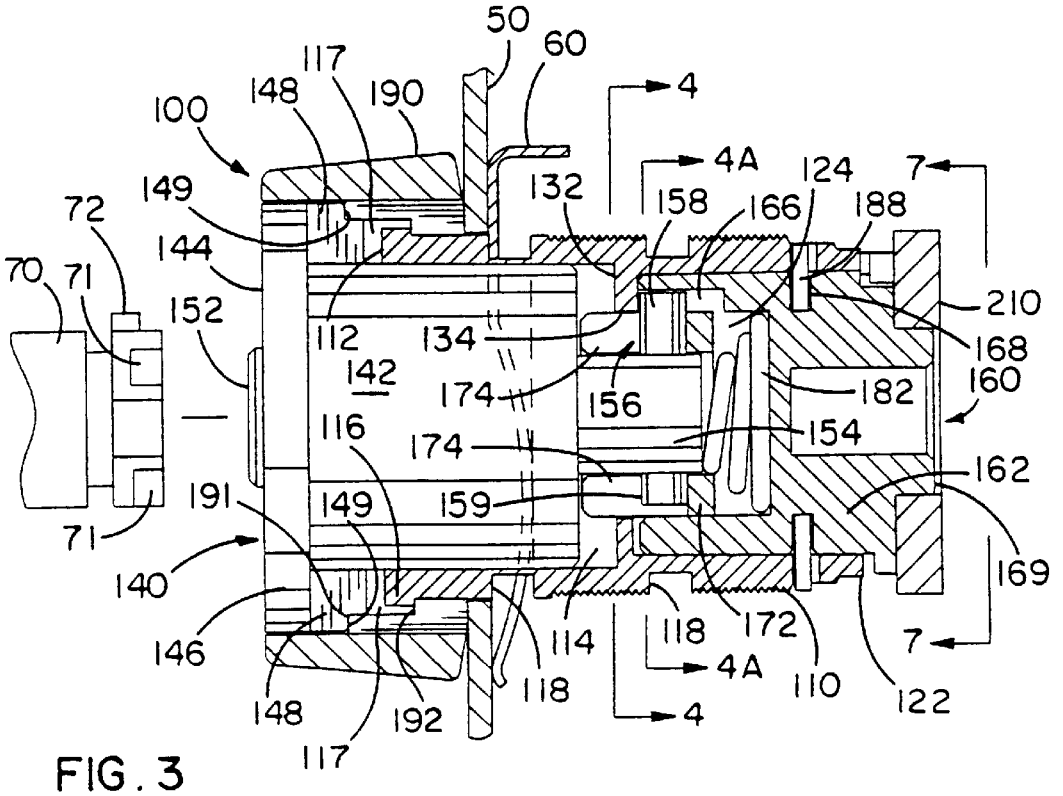
FIG. 3 is a cross-sectional view of the lock assembly taken along line 3—3 of FIG. 2, and showing the lock assembly mounted to an external panel.
Figure 12:
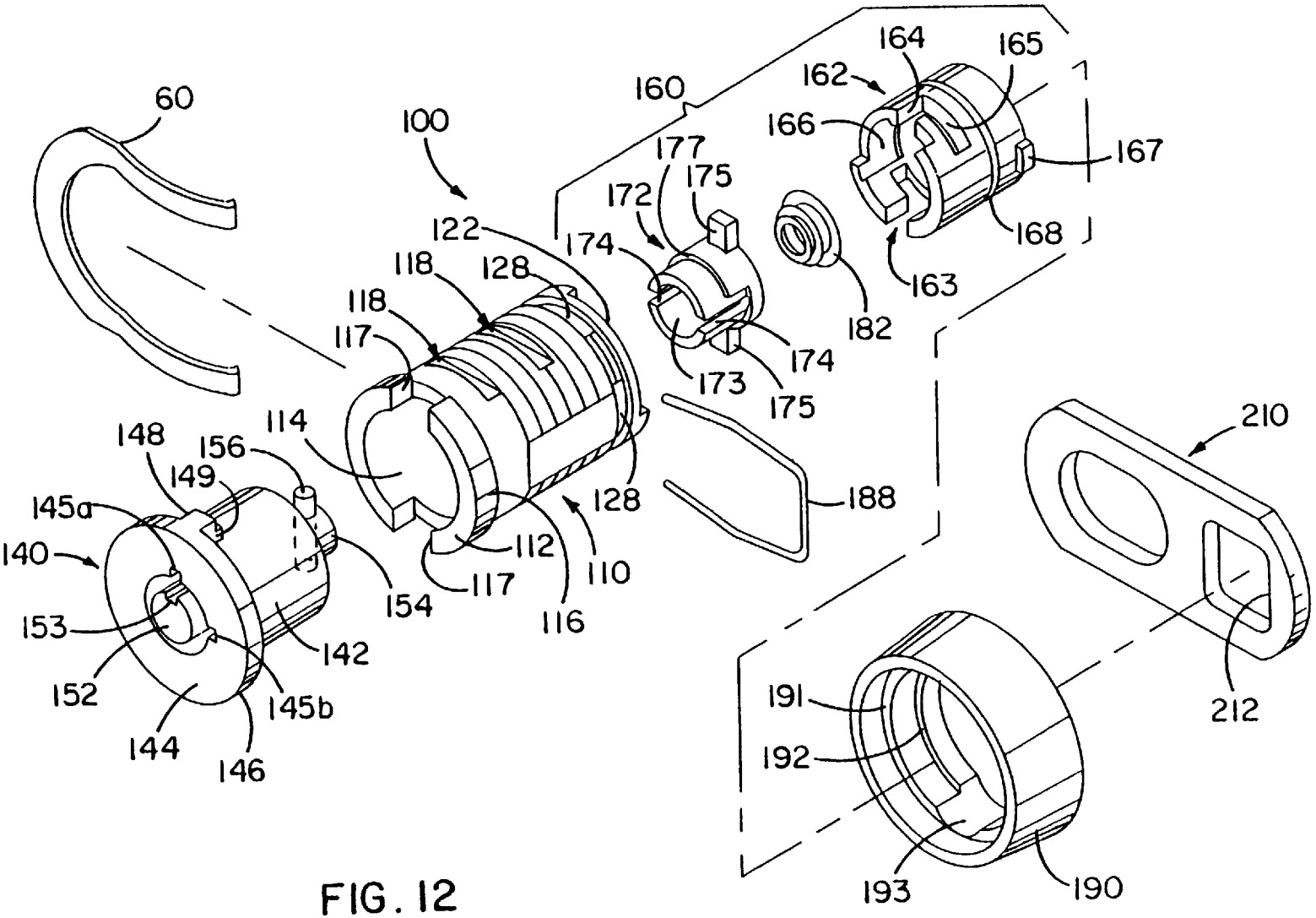
FIG. 12 is an exploded perspective view of the lock assembly depicted in FIGS. 1–11.

In accordance with an important aspect of the present invention, the inventive lock assembly 100 is provided with a core structure 140 which is selectively removably disposed within the first internal compartment 114 of the housing 110. As best shown in FIG. 12, the removable core structure 140 of the present invention includes an exterior shell portion 142 and an interior lock plug assembly 152 rotatably disposed within the shell portion 142. In the illustrated embodiment, the exterior shell portion 142 includes a front face portion 144 with an outward annular flange 146 and a pair of diametrically opposed lugs 148 with associated indentations 149. When the core structure 140 is properly disposed within the first internal compartment 114 of the housing 110, the opposed notches 117 of the housing 110 at least partially receive the opposed lugs 148 of the core structure 140, as shown in FIG. 3. The interior lock plug assembly 152 is provided with a generally cylindrical distal driver portion 154 which protrudes longitudinally beyond the aft end of the shell portion 142. As shown, for example, in FIGS. 4–6A, the distal driver portion 154 includes a transverse member 156, in the form of a pin or the like, with a relatively long portion 158 and a relatively short portion 159. As will be described in greater detail below, the transverse member or pin 156 of the driver portion 154 interacts with the partition 132 of the housing 110 and the radial slot 136 of the partition 132 to permit selective removal of the core structure 140 from the first internal compartment 114 of the housing 110.

Figure 1:
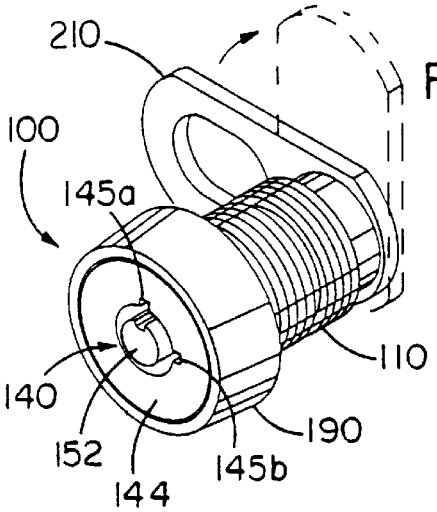
FIG. 1 is a perspective view of a lock assembly having a key-activated removable core structure constructed in accordance with the present invention.
Figure 2:
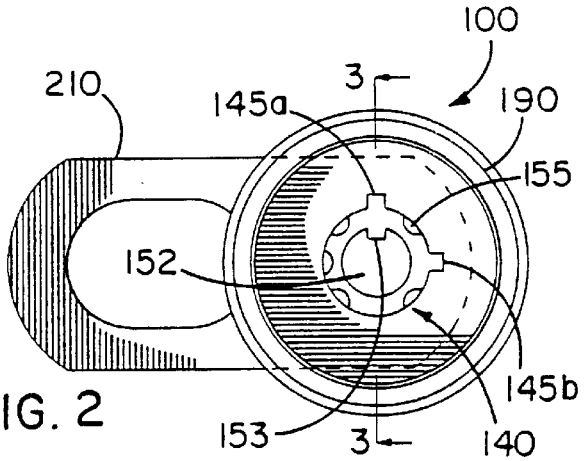
FIG. 2 is an enlarged front elevational view of the lock assembly depicted in FIG. 1, showing a lock plug assembly of the removable core structure in a first operating position.

In the illustrated embodiment, the lock plug assembly 152 is of axial pin tumbler construction and is movable between first, second, and third operating positions when the removable core structure 140 is properly installed in the first internal compartment 114 of the housing 110 and the lock plug assembly 152 is turned by a properly-fitting key 70. As shown in FIGS. 1–3, the key 70 includes a radial lug projection 72 which is received by one of two cooperating radial grooves 145*a* and 145*b* formed in the front face portion 144 of the core structure 140 and by a radial slot 153 formed in the lock plug assembly 152. As is customary in the art, the key 70 also includes a plurality of encoded notches 71 which engage cooperating driver pins 153 disposed within the lock plug assembly 152.

With reference to FIGS. 1, 2, and 12, the first, second, and third operating positions of the lock plug assembly 152 correspond to particular angular orientations. In particular, the first operating position corresponds to the twelve o'clock position where the slot 153 of the lock plug assembly 152 is aligned with the first radial groove 145*a* of the core structure 140, as shown in FIGS. 1, 2, and 12, the second operating position corresponds to the three o'clock position where the slot 153 of the lock plug assembly 152 is aligned with the second radial groove 145*b* of the shell portion 142 (i.e., 90° clockwise of the first operating position), and the third operating position is disposed approximately halfway between the three o'clock position and the six o'clock position (i.e., approximately 45° clockwise of the second operating position). In the first and second operating positions, the key 70 is insertable into and removable from the core structure 140 because the radial lug projection 72 of the key 70 is aligned with radial grooves 145*a* and 145*b* of the shell portion 142, respectively. In the third operating position, however, the key 70 is not removable from the core structure 140 because the radial lug projection 72 is not aligned with either of the two radial grooves 145*a* or 145*b* of the shell portion 142. Although a specific type of lock plug assembly 152 is described and illustrated herein, it will be readily appreciated by those skilled in the art that other types of lock plug assemblies may alternatively be used without departing from the scope or spirit of the present invention.

In order to selectively retain the removable core structure 140 within the first internal compartment 114 of the housing 110, the inventive lock assembly 100 is also provided with a cam actuation assembly 160 which is captively rotatably disposed within the second internal compartment 124 of the housing 110. As best shown in FIG. 12, the cam actuation assembly 160 of the present invention includes an interior insert portion 172 which is received by and disposed within an exterior drum portion 162. More specifically, the insert portion 172 has a bore 173 formed therein which removably receives the driver portion 154 of the lock plug assembly 152, a pair of opposed longitudinal slots 174 which removably receive the pin 156 of the driver portion 154, a pair of opposed protrusions 175, and a partial annular stop 177 formed around its outer periphery. The drum portion 162, in turn, includes a pair of opposed channels 163 which receive the protrusions 175 of the insert portion 172 and an arcuate interior notch 166 which removably receives the long portion 158 of the pin 156. In the illustrated embodiment, each opposed channel 163 of the drum portion 162 has a generally L-shaped configuration with a generally longitudinal segment 164 and a generally transverse segment 165.

On account of this construction, the insert portion 172 always rotates in conjunction with the driver portion 154 of the lock plug assembly 152, but selectively rotates with respect to the drum portion 162 of the cam actuation assembly 160. For example, when the lock plug assembly 152 is turned by key 70, the insert portion 172 rotates in conjunction with the driver portion 154 because the pin 156 acts against the sides of the opposed longitudinal slots 174 of the insert portion 172. In addition, when the protrusions 175 of the insert portion 172 are disposed within the longitudinal segments 164 of the opposed channels 163 of the drum portion 162, the protrusions 175 act against longitudinal segments 164 which causes the insert portion 172 to rotate in conjunction with the drum portion 162. When the protrusions 175 of the insert portion 172 are disposed within the transverse segments 165 of the opposed channels 163, however, the insert portion 172 is free to rotate relative to the drum portion 162 because the protrusions 175 are no longer captured by the longitudinal segments 164.

In keeping with an important aspect of the present invention, the cam actuation assembly 160 is also provided with a biasing element 182, in the form of a coil spring or the like, which urges or biases the core structure 140 into a first axial or outward position with respect to the front end 112 of the housing 110. As shown in FIG. 3, the biasing element 182 is compressibly disposed between the drum portion 162 and the insert portion 172. When the core structure 140 is installed within the first internal compartment 114 of the housing 110, the biasing element 182 acts against the driver portion 154 of the lock plug assembly 152 to urge the core structure 140 into the first axial position wherein the outward annular flange 146 and the opposed lugs 148 of the core structure 140 are spaced apart from the annular flange 116 and the opposed notches 117 of the housing 110, as shown, for example, in FIG. 3. The biasing element 182 also protrudes partly into the bore 173 of the insert portion 172 and pushes the insert portion 172 partially through the aperture 134 of the partition 132 until the annular stop 177 of the insert portion 172 engages or seats against the partition 132 of the housing 110. Although a specific type of biasing element 182 is described and illustrated herein, it will be readily appreciate that other types of biasing elements may alternatively be used without departing from the scope or spirit of the present invention.

Figure 7:
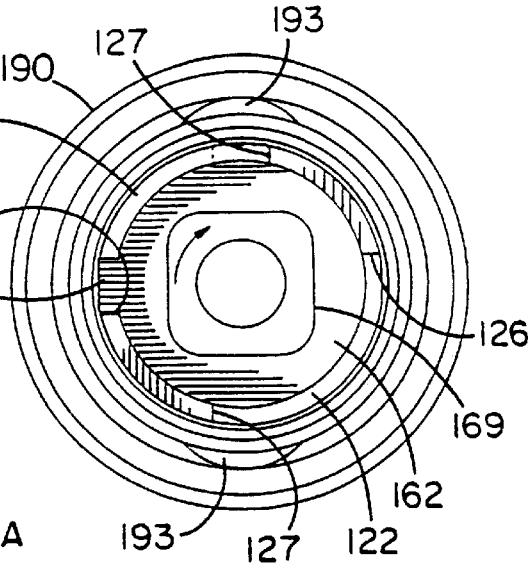
FIG. 7 is an enlarged rear end view of the lock assembly, as seen in the direction of line 7—7 of FIG. 3.

As best shown in FIGS. 7 and 12, the aft end of drum portion 162 is provided with a radially projecting finger 167 which selectively engages the first and second stop surfaces 126 and 127 of the rear end 122 of the housing 110 as the lock plug assembly 152 is moved between the first, second, and third operating positions. More specifically, when the lock plug assembly 152 is in the first operating position, the projecting finger 167 engages first stop surface 126, as shown in FIG. 7. When the lock plug assembly 152 is in the second and third operating positions, however, the projecting finger 167 engages second stop surface 127.

The aft end of the drum portion 162 is also provided with a hub 169 which is adapted to receive an attachable cam member 210 having a complementary opening 212 formed therein. When the lock plug assembly 152 is rotated between the first and second operating positions, the cam member 210 rotates in conjunction with both the lock plug assembly 152 and the drum portion 162 of the cam actuation assembly 160, as portrayed, for example, in FIG. 1.

In order to rotatably retain or capture the cam actuation assembly 160 within the second internal compartment 124 of the housing 110, the drum portion 162 is also provided with an annular groove 168 disposed around its outer periphery for receiving a spring retaining clip 188 or the like. As shown in FIG. 12, the cam actuation assembly 160 is rotatably captured within the second internal compartment 124 of the housing 110 by inserting the retaining clip 188 through aligned slots 128 formed in the housing 110 until the clip 188 engages the annular groove 168 of the drum portion 162.

In operation, the transverse member or pin 156 of the driver portion 154 interacts with the cam actuation assembly 160 to selectively retain the core structure 140 within the first internal compartment 114 of the housing 110 depending upon the operating position of the lock plug assembly 152. For example, when the lock plug assembly 152 is in the first and second operating positions, as shown in FIGS. 4A and 5A, respectively, the long portion 158 of the pin 156 is arranged adjacent to the counter-clockwise side of the arcuate interior notch 166 of the drum portion 162 while the opposed protrusions 175 of the insert portion 172 are disposed within the longitudinal segments 164 of the opposed channels 163 of the drum portion 162. In addition, the biasing element or spring 182 of the cam actuation assembly 160 presses the insert portion 172 forwardly within the second internal compartment 124 of the housing 110 until the long portion 158 of the pin 156 obstructively engages the partition 132 of the housing 110, as shown, for example, in FIG. 3. This obstructive engagement between the pin 156 of the driver portion 152 and the partition 132 of the housing 110 prevents the core structure 140 from being removed from the first internal compartment 114 of the housing 110. Of course, when the lock plug assembly 152 is in either the first or second operating positions, the key 70 may be conveniently withdrawn therefrom because the radial lug projection 72 of the key 70 is aligned with radial grooves 145*a* and 145*b* of the shell portion 142.

Figure 8B:
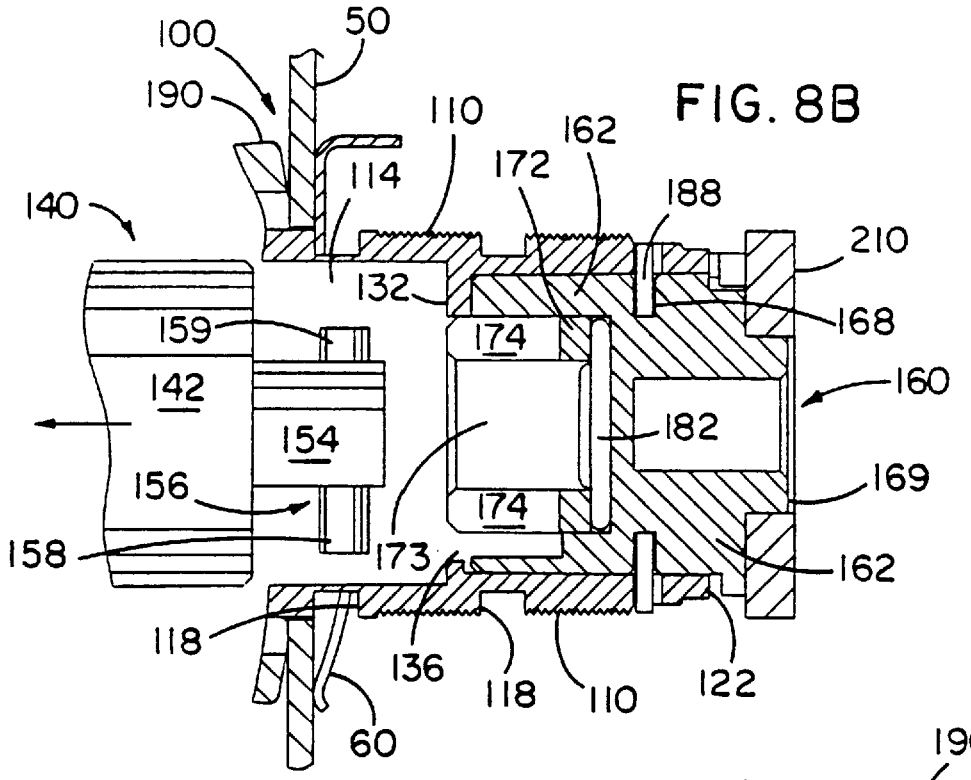
FIG. 8B is an enlarged cross-sectional view of the lock assembly taken along line 8—8 of FIG. 6, but showing the removable core structure being withdrawn from the remainder of the lock assembly.
Figure 9:
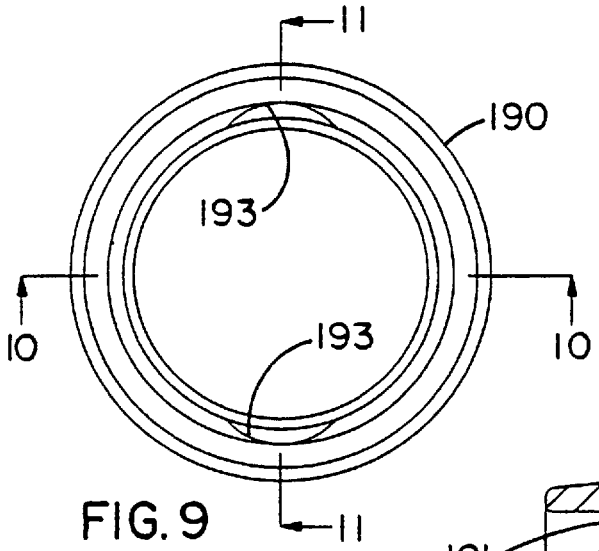
FIG. 9 is an enlarged top plan view of a collar for the lock assembly.
Figure 10:
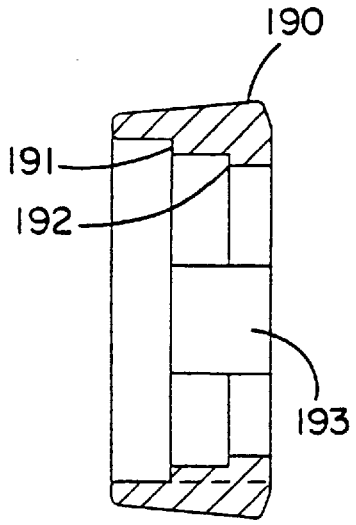
FIG. 10 is a cross-sectional view of the collar taken along line 10—10 of FIG. 9.
Figure 11:
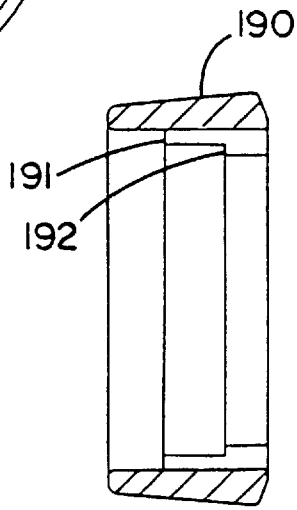
FIG. 11 is a cross-sectional view of the collar taken along line 11—11 of FIG. 9.

When the lock plug assembly 152 is in the third operating position, however, the long portion 158 of the pin 156 is arranged adjacent to the clockwise side of the arcuate interior notch 166 of the drum portion 162, as shown in FIG. 6A. In addition, the opposed protrusions 175 of the insert portion 172 are disposed at the ends of the transverse segments 165 of the opposed channels 163 of the drum portion 162. In keeping with an important aspect of the present invention, the long portion 158 of the pin 156 is also aligned with the radial slot 136 of the partition 132, as shown in FIG. 6, which allows the core structure 140 to be advantageously removed from the first internal compartment 114 of the housing 110, as shown in FIG. 8B. In addition, since the radial lug projection 72 of the key 70 is not in alignment with either radial groove 145*a* or radial groove 145*b* of the shell portion 142, the core structure 140 and the key 70 are conveniently withdrawn from the first internal compartment 114 of the housing 110 as a collective unit. In this way, the lock assembly 100 of the present invention provides a key-activated removable core structure 140.

To move the lock plug assembly 152 from the first operating position to the second operating position, the key 70 is inserted into the lock plug assembly 152 and is rotated 90° clockwise. When the lock plug assembly 152 is rotated in this manner, the transverse member or pin 156 of the driver portion 154 acts against the longitudinal slots 174 of the insert portion 172 which causes the insert portion 172 to rotate in conjunction with the lock plug assembly 152. In addition, the opposed protrusions 175 of the insert portion 172 act against the longitudinal segments 164 of the opposed channels 163 of the drum portion 162 which causes the drum portion 162 to rotate in conjunction with both the lock plug assembly 152 and the insert portion 172, but relative to the stationary housing 110 and shell portion 142 of the core structure 140. Upon reaching the second operating position, the projecting finger 167 of the drum portion 162 engages second stop surface 127 of the housing 110 which prevents further rotation of the drum portion 162 with respect to the housing 110.

To move the lock plug assembly 152 from the second operating position to the third operating position, the core structure 140 is initially moved inwardly from the first axial position shown in FIG. 3 to a second or inward axial position, and then the key 70 and the lock plug assembly 152 are rotated further clockwise. More specifically, the lock plug assembly 152 is moved from the second operating position to the third operating position by pressing the key 70 and the core structure 140 inwardly until the biasing provided by the spring 182 is overcome and the opposed protrusions 175 of the insert portion 172 are aligned with the transverse segments 165 of the opposed channels 163, and then by rotating the key 70 and the lock plug assembly 152 in a clockwise direction until the opposed protrusions 175 reach the ends of the transverse segments 165 and the pin 156 of the driver portion 154 is aligned with the radial slot 136 of the partition 132, as shown, for example, in FIGS. 6 and 8. Because the opposed protrusions 175 of the insert portion 172 are captured by the transverse segments 165 of the opposed channels 163 of the drum portion 162, the biasing element or spring 182 remains in a compressed state even when the core structure 140 is removed from the first internal compartment 114 of the housing 110, as shown, for example, in FIGS. 8 and 8B.

When the lock plug assembly 152 is moved from the second operating position towards the third operating position, the transverse member or pin 156 of the driver portion 154 acts against the longitudinal slots 174 of the insert portion 172 while the opposed protrusions 175 of the insert portion 172 move along the transverse segments 165 of the opposed channels 163 of the drum portion 162. Since the projecting finger 167 of the drum portion 162 is bottomed out against the second stop surface 127 of the housing 110, however, the drum portion 162 of the cam actuation assembly 160 remains stationary with respect to the housing 110. As such, the insert portion 172 rotates in conjunction with the pin 156 of the lock plug assembly 152, but relative to both the drum portion 162 of the cam actuation assembly 160 and the housing 110.

In accordance with an important aspect of the present invention, the core structure 140 of the present invention may be advantageously removed from the first internal compartment 114 of the housing 110 by perfoming the following operations: installing the key 70; rotating the lock plug assembly 152 into the second operating position; moving the core structure 140 inwardly from the first axial position to the second axial position; rotating the lock plug assembly 152 into the third operating position; and withdrawing the key 70 and the core structure 140 as a collective unit.

In accordance with another important aspect of the present invention, the security collar 190 selectively prevents the core structure 140 from moving inwardly from the first axial position towards the second axial position. The collar 190 also permits the core structure 140 to be conveniently removed from the first internal compartment 114 of the housing 110 when the housing 110 is mounted to panel 50 or the like. As best shown in FIG. 3, the collar 190 is adapted to fit around both the outward annular flange 146 of the core structure 140 and the annular flange 116 of the housing 110. The collar is also adapted to seat against the panel 50 and to rotate with respect thereto.

As best shown in FIGS. 9–12, the collar 190 includes a first abutment surface in the form of a first internal annular flange 191, a second abutment surface in the form of a second internal annular flange 192, and a pair of opposed arcuate channels 193. The first internal annular flange 191 is sized to receive the outward annular flange 146 of the core structure 140, the second internal annular flange 192 is sized to receive the annular flange 116 of the housing 110, and the opposed arcuate channels 193 are adapted to selectively receive the opposed lugs 148 of the core structure 140.

When the inventive lock assembly 100 is mounted to panel 50, the annular flange 116 of the housing 110 seats against the second internal annular flange 192 of the collar 190. In addition, the outward annular flange 146 and the opposed lugs 148 of the core structure 140 selectively engage the first internal annular flange 191 of the collar 190—depending upon the alignment of the core structure 140 with respect to the collar 190—to selectively prevent the core structure 140 from moving inwardly from the first axial position to the second axial position. For example, when the opposed lugs 148 of the core structure 140 are out of alignment with the opposed channels 193 of the collar 190, the core structure 140 is retained in the first axial position and is prevented from moving inwardly towards the second axial position by engagement between the indentations 149 formed in the opposed lugs 148 of the core structure 140 and the first internal annular flange 191 of the collar 190. When the opposed lugs 148 of the core structure 140 are aligned with the opposed channels 193 of the collar 190, however, the core structure 140 may be moved inwardly towards the second axial position. More specifically, the core structure 140 may be pressed inwardly until the outward annular flange 146 of the core structure 140 engages both the annular flange 116 of the housing 110 and the first internal annular flange 191 of the collar 190, and until the opposed lugs 148 of the core structure 140 are fully received by the opposed notches 117 of the housing 110.

In operation, the core structure 140 may be moved into the second axial position by inserting the key 70 into the lock plug assembly 152, by turning the key 70 and the core structure 140 with respect to the collar 190 until the lock plug assembly 152 reaches the second operating position and the opposed lugs 148 of the core structure 140 are aligned with the opposed channels 193 of the collar 190, and by exerting a sufficient inward force to overcome the biasing provided by spring 182 of the cam actuation assembly 160. Thereafter, the lock plug assembly 152 may be rotated into the third operating position to effectuate convenient removal of the core structure 140 from the first internal compartment 114 of the housing 110.

Thus, in keeping with an important aspect of the present invention, the core structure 140 is removable from both the collar 190 and the housing 110 when the opposed lugs 148 of the core structure 140 are aligned with the opposed channels 193 of the collar 190, the core structure 140 is in the second axial position, and the lock plug assembly 152 is in the third operating position. In particular, the core structure 140 and the key 70 may be collectively removed from the collar 190 and the first internal compartment 114 of the housing 110 by: inserting the key 70 into the lock plug assembly 152; rotating the lock plug assembly 152 into the second operating position; rotating the core structure 140 with respect to the collar 190 or vice versa until the opposed lugs 148 of the core structure 140 are in alignment with the opposed channels 193 of the collar 190; pressing the key 70 inwardly toward the panel 50 until the biasing provided by spring 182 is overcome, the core structure 140 reaches the second axial position, and the opposed protrusions 175 of the insert portion 172 are in alignment with the transverse segments 165 of the opposed channels 163 of the drum portion 162; rotating the lock plug assembly 152 from the second operating position to the third operating position until the transverse member or pin 156 of the driver portion 154 is in alignment with the radial slot 136 of the partition 132; and withdrawing the key 70 away from the housing 110, the collar 190, and the panel 50 to collectively remove the core structure 140 and the key 70 from the first internal compartment 114 of the housing 110. Of course, after the core structure 140 has been removed, the housing 110 and the collar 190 will remain attached to the panel 50 by virtue of the lock clip 60 and engagement between the annular flange 116 of the housing 110 and the second internal annular flange 192 of the collar 190.

From the foregoing teachings, it will be readily appreciated that modifications, variations, and alternatives may be effectuated to the disclosed structures without departing from the scope or spirit of the present invention. As such, no limitation with respect to the preferred exemplified embodiment disclosed herein is intended or should be inferred. Indeed, the following claims are intended to cover all such alternatives, modifications, and equivalents that fall within the spirit and scope of the present invention.

What is claimed is:

1. A lock assembly comprising:

a housing having a first internal compartment disposed at a front and thereof and second internal compartment disposed at a rear and thereof;

a core structure selectively removably disposed within the first internal compartment of the housing, the core structure including an exterior shell portion and a key-activated lock plug assembly rotatably disposed within the shell portion, the lock plug assembly including a distal driver portion;

a cam actuation assembly captively rotatably disposed within the second internal compartment of the housing, the cam actuation assembly selectively removably receiving the driver portion of the lock plug assembly and including a biasing element which urges the core structure into a first axial position; and a collar disposed around the front end of the housing, the collar selectively preventing the core structure from moving towards a second axial position;

wherein the lock plug assembly rotates the cam actuation assembly when the core structure is in the first axial position and the lock plug assembly is rotated between first and second operating positions with a key, and wherein the core structure is removable when the first internal compartment of the housing when the core structure is moved into the second axial position and the lock plug assembly is rotated into a third operation position with the key.

2. The lock assembly set forth in claim 1, wherein the collar includes a first abutment surface which normally engages at least a portion of the core structure to prevent the core structure from moving towards the second axial position.

3. The lock assembly set forth in claim 2, wherein the core structure includes lugs.

4. The lock assembly set forth in claim 3, wherein the collar includes channels which are adapted to selectively receive the lugs of the core structure, the collar allowing the core structure to move into the second axial position when the lugs of the core structure are aligned with the channels of the collar.

5. The lock assembly set forth in claim 1, wherein the collar includes a first internal annular flange which is sized to receive an outward annular flange formed on the core structure, a second internal annular flange which is sized to receive an annular flange formed on the front end of the housing, and channels which are adapted to receive lugs formed on the outward annular flange of the core structure when the collar is properly oriented with respect to the core structure.

6. The lock assembly set forth in claim 1, wherein the housing and the collar are adapted to be collectively mounted against an external mounting structure.

7. The lock assembly set forth in claim 1, wherein the housing includes a partition which segregates the first and second internal compartments, the partition having an aperture therethrough which removably receives the driver portion of the lock plug assembly and a generally radial slot.

8. The lock assembly set forth in claim 7, wherein the driver portion of the lock plug assembly includes a generally transverse member which interacts with the partition and the slot of the housing to permit selective removal of the core structure from the first internal compartment of the housing.

9. The lock assembly set forth in claim 8, wherein the transverse member of the driver portion engages the partition of the housing when the lock plug assembly is in the first and second operating positions thereby preventing removal of the core structure from the first internal compartment of the housing.

10. The lock assembly set forth in claim 8, wherein the transverse member of the driver portion is aligned with the radial slot of the partition when the lock plug assembly is in the third operating position thereby allowing removal of the core structure from the first internal compartment of the housing.

11. The lock assembly set forth in claim 8, wherein the cam actuation assembly includes an exterior drum portion and an interior insert portion disposed within the drum portion, the insert portion having a bore therein which removably receives the driver portion of the lock plug assembly and at least one longitudinal slot which removably receives the transverse member of the driver portion.

12. The lock assembly set forth in claim 11, wherein the drum portion of the cam actuation assembly includes a radially projecting finger and the rear end of the housing includes first and second stop surfaces, the finger engaging the first stop surface when the lock plug assembly is in the first operating position and engaging the second stop surface when the lock plug assembly is in the second and third operating positions.

13. The lock assembly set forth in claim 11, wherein the insert portion of the cam actuation assembly includes a pair of opposed protrusions, and wherein the drum portion of the cam actuation assembly includes a pair of opposed channels which receive the protrusions of the insert portion and an arcuate interior notch which removably receives the transverse member of the driver portion.

14. The lock assembly set forth in claim 13, wherein each opposed channel of the drum portion includes a generally longitudinal segment and a generally transverse segment.

15. The lock assembly set forth in claim 14, wherein the opposed protrusions of the insert portion are disposed within the longitudinal segments of the opposed channels when the lock plug assembly is rotated between the first and second operating positions thereby causing the drum portion to rotate in conjunction with the insert portion.

16. The lock assembly set forth in claim 14, wherein the opposed protrusions of the insert portion are disposed within the transverse segments of the opposed channels when the lock plug assembly is rotated between the second and third operating positions thereby allowing the insert portion to rotate with respect to the drum portion.

17. The lock assembly set forth in claim 9, wherein the drum portion of the cam actuation assembly includes a hub which is adapted to receive an attachable cam member.

18. A lock assembly comprising:

a housing having a first internal compartment disposed at a front end thereof, a second internal compartment disposed at a rear end thereof, and a partition between the first and second internal compartments, the partition having an aperture therethrough with a generally radial slot;

a core structure selectively removably disposed within the first internal compartment of the housing, the core structure including an exterior shell portion and an interior lock plug assembly rotatably disposed within the shell portion for movement between first, second, and third operating positions when turned by a properly-fitting key, the lock plug assembly including a distal driver portion, the driver portion including a transverse member;

a cam actuation assembly captively rotatably disposed within the second internal compartment of the housing, the cam actuation assembly being adapted to removably receive the driver portion oft he lock plug assembly and to selectively retain the core structure within the first internal compartment of the housing, the cam actuation assembly including a biasing element which urges the core structure into a first axial position with respect to the front end of the housing; and a collar adapted to fit around the front end of the housing and adapted to selectively prevent the core structure from moving into a second axial position with respect to the front end of the housing;

wherein the core structure is non-removable form the first internal compartment of the housing when the core structure is in the first axial position and the lock plug assembly is in the first and second operating positions due to engagement between the transverse member of the driver portion and the partition of the housing, and wherein the core structure is removable from the first internal compartment of the housing when the core structure is in the second axial position and the lock plug assembly is in the third operating position due to alignment of the transverse member of the driver portion and the radial slot of the partition.

* * * * *